US007540058B1

(12) United States Patent
Day

(10) Patent No.: US 7,540,058 B1
(45) Date of Patent: Jun. 2, 2009

(54) PAINTING TOOL ASSEMBLY

(76) Inventor: Greg H. Day, 13325 Shoshone St., West Minster, CO (US) 80234

( * ) Notice: Subject to any disclaimer, the term of this patent is extended or adjusted under 35 U.S.C. 154(b) by 0 days.

(21) Appl. No.: 11/960,873

(22) Filed: Dec. 20, 2007

(51) Int. Cl.
*B25G 3/12* (2006.01)

(52) U.S. Cl. ..... 15/230.11; 15/145; 16/422; 16/426; 16/427; 403/109.3; 403/322.2; 492/13; 492/19

(58) Field of Classification Search ..... 15/145, 15/230.11; 16/422, 426, 427; 492/13, 19; 403/109.2, 109.3, 322.2
See application file for complete search history.

(56) References Cited

U.S. PATENT DOCUMENTS

| | | | | |
|---|---|---|---|---|
| 599,783 | A * | 3/1898 | Hogan | 411/318 |
| 789,021 | A * | 5/1905 | Hartman | 403/301 |
| 860,270 | A * | 7/1907 | Trewhella | 403/329 |
| 986,761 | A * | 3/1911 | Roscoe | 279/77 |
| 3,524,210 | A * | 8/1970 | McLean | 15/145 |
| 3,596,304 | A * | 8/1971 | Welt | 15/230.11 |
| 4,793,646 | A | 12/1988 | Michaud, Jr. | |
| 5,579,558 | A | 12/1996 | Newman, Jr. et al. | |
| 5,729,865 | A | 3/1998 | Stoddart | |
| 6,546,596 | B2 | 4/2003 | Grote et al. | |
| D519,820 | S | 5/2006 | Newman et al. | |
| 2006/0147256 | A1 | 7/2006 | Richardson et al. | |

* cited by examiner

*Primary Examiner*—Mark Spisich

(57) ABSTRACT

A painting tool assembly includes an elongated pole having a first end and a second end. The elongated pole has a length greater than three feet. A roller mounting releasably couples to a paint roller. The paint roller is rotatable along a longitudinal axis of the paint roller. The roller mounting receives and is removably coupled to the first end of the pole. A locking member is mounted on the pole and releasably locks the pole to the roller mounting.

7 Claims, 3 Drawing Sheets

PAINTING TOOL ASSEMBLY

BACKGROUND OF THE INVENTION

Field of the Invention

The present invention relates to paint roller mountings and more particularly pertains to a new paint roller mounting for ensuring a stable connection between a paint roller and an extension pole.

SUMMARY OF THE INVENTION

The present invention meets the objectives presented above by generally comprising an elongated pole having a first end and a second end. The elongated pole has a length greater than three feet. A roller mounting releasably couples to a paint roller. The paint roller is rotatable along a longitudinal axis of the paint roller. The roller mounting receives and is removably coupled to the first end of the pole. A locking member is mounted on the pole and releasably locks the pole to the roller mounting.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
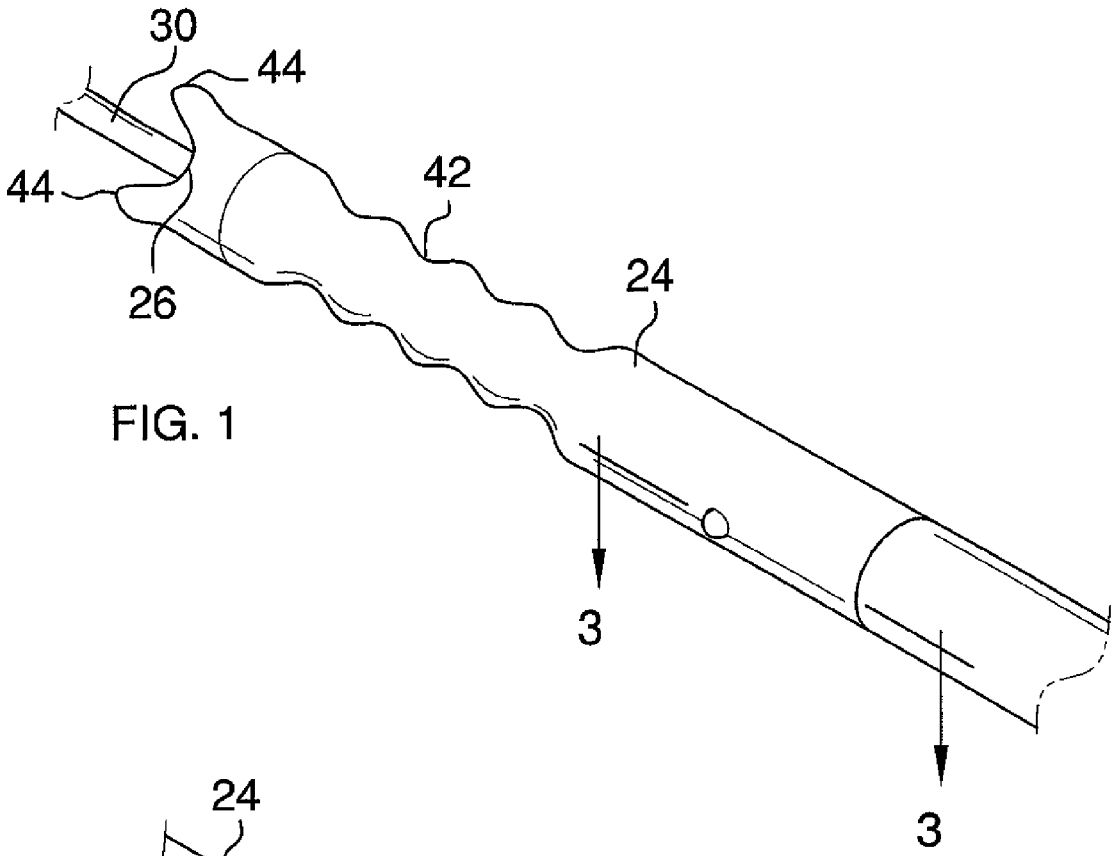
FIG. 1 is a perspective view of a painting tool assembly according to the present invention.
Figure 2:
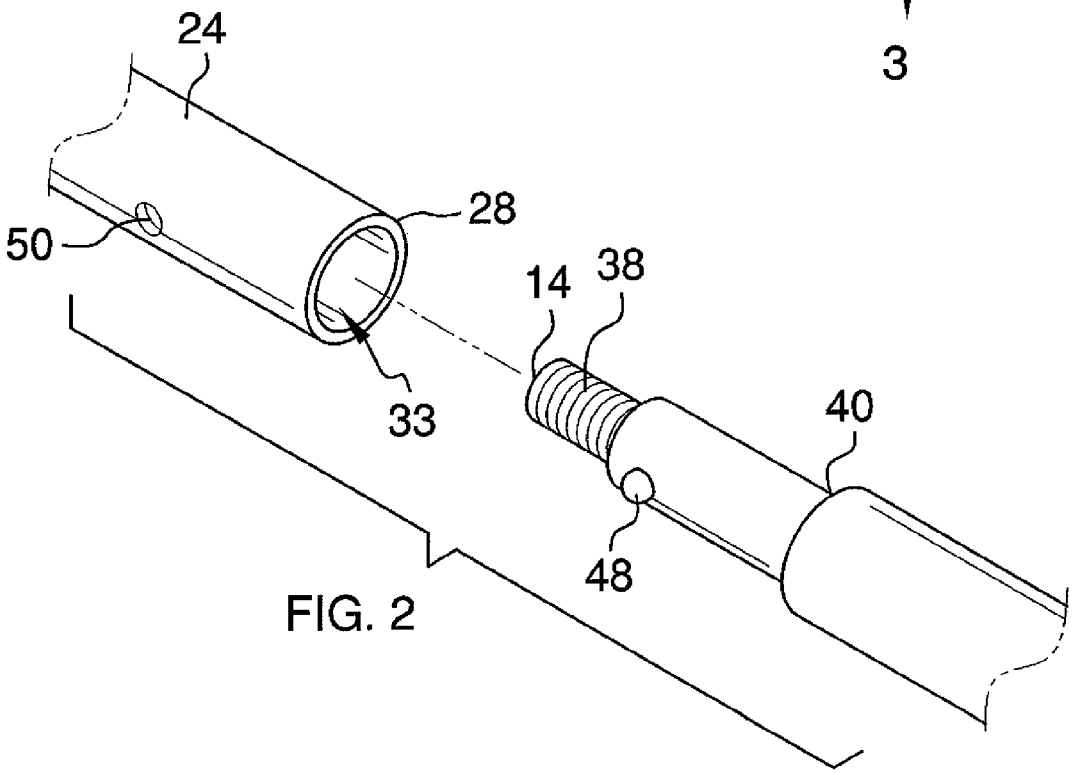
FIG. 2 is an expanded perspective view of the present invention.
Figure 3:
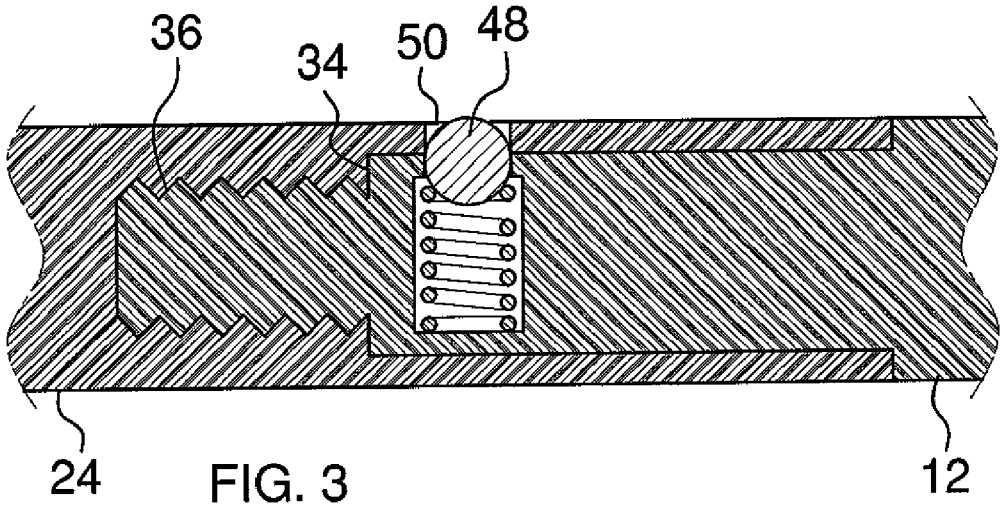
FIG. 3 is a cross-sectional view taken along line 3-3 of FIG. 1 of the present invention.
Figure 4:
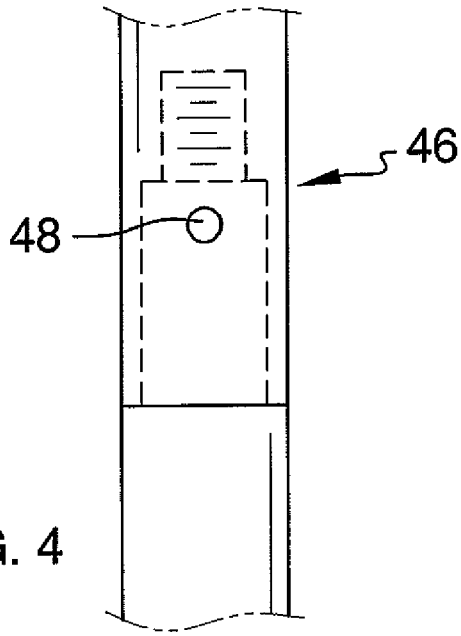
FIG. 4 is a side view of the present invention.
Figure 5:
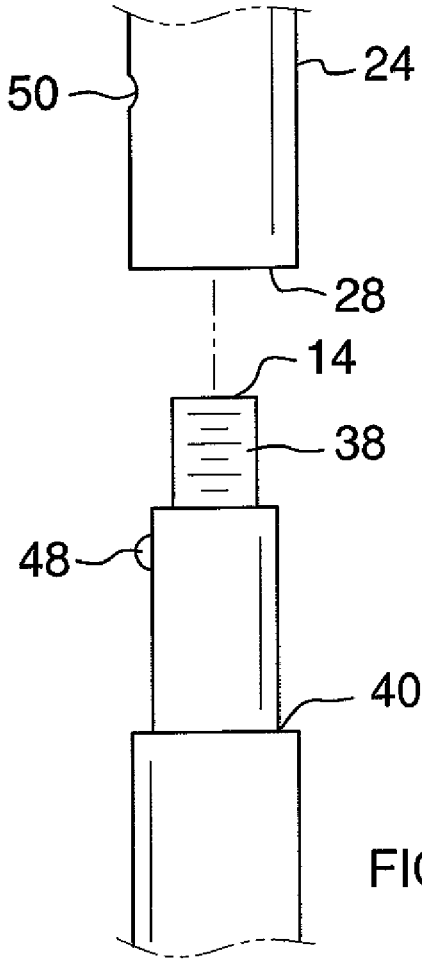
FIG. 5 is a front expanded view of the present invention.
Figure 6:
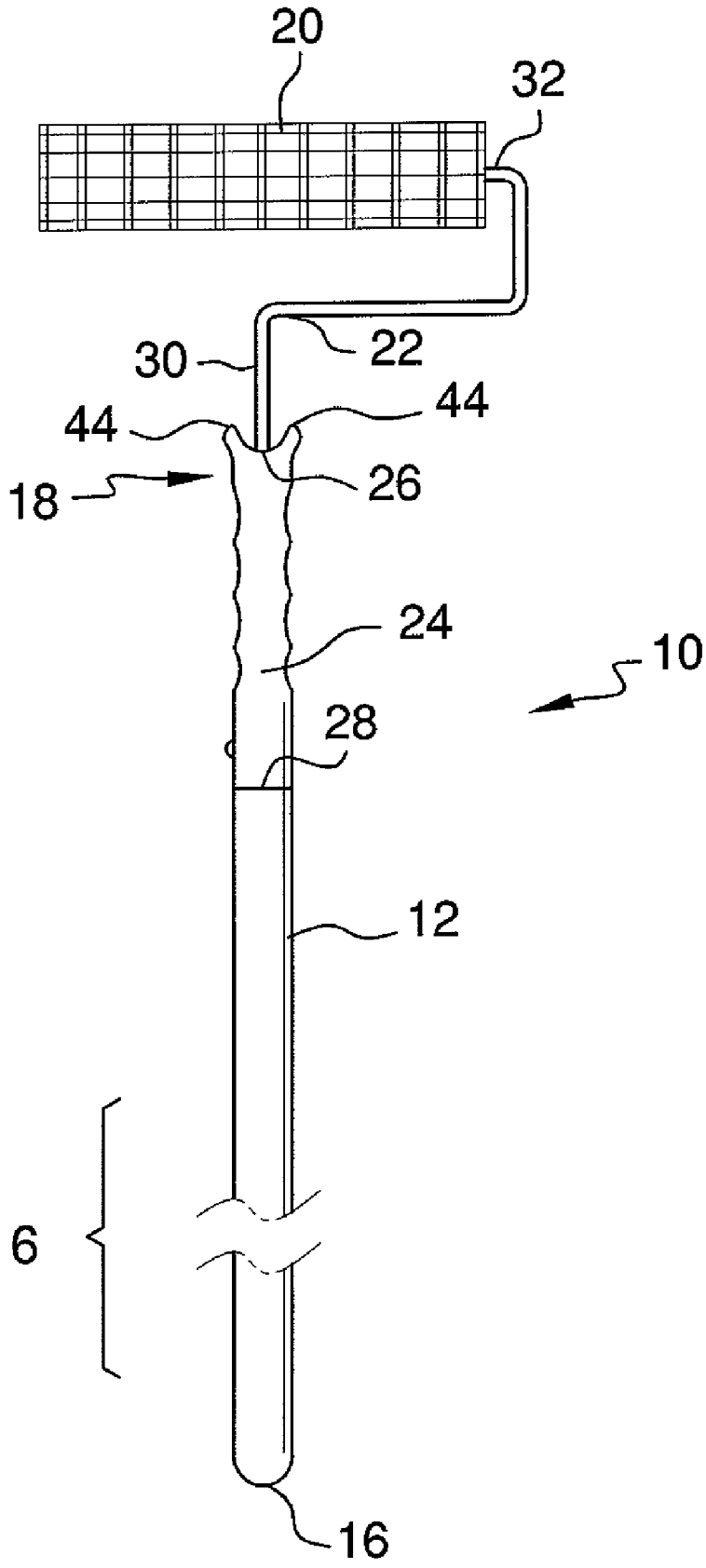
FIG. 6 is a front view of the present invention.

With reference now to the drawings, and in particular to FIGS. 1 through 6 thereof, a new paint roller mounting embodying the principles and concepts of the present invention and generally designated by the reference numeral 10 will be described.

As best illustrated in FIGS. 1 through 6, the painting tool assembly 10 generally comprises an elongated pole 12 that has a first end 14 and a second end 16. The elongated pole 12 has a length greater than three feet.

A roller mounting 18 is releasably coupled to a paint roller 20. The paint roller 20 is rotatable along a longitudinal axis of the paint roller 20. The roller mounting 18 receives and is removably coupled to the first end 14 of the pole 12. The roller mounting 18 includes a post 22 and an elongated handle 24 that is attached to the post 22. The handle 24 has a proximal end 26 and a distal end 28 with respect to the post 22. The post 22 is attached to the proximal end 26. The first end 14 of the pole 12 extends into the distal end 28 of the handle 24.

The post 22 is a conventional paint roller connector and includes an extension portion 30 and a roller portion 32. The extension portion 30 positions the roller portion 32 in a spaced relationship with the handle 24. The roller portion 32 extends into the paint roller 20 and is collinear with the longitudinal axis of the paint roller 20. A longitudinal axis of the pole 12 is oriented perpendicular to and bisects the longitudinal axis of the paint roller 20.

The distal end 28 of the handle 24 has a lumen 33 extending therein. The lumen 33 has a terminal wall 34 spaced from the distal end 28 of the handle 24. The terminal wall 34 has a threaded well 36 extending therein. An outer surface 38 of the pole 12 adjacent to the first end 14 is threaded and is extended into and threadably coupled to the threaded well 36. The outer surface 38 of the pole 12 includes a perimeter shoulder 40. The shoulder 40 abuts the distal end 28 of the handle 24 when the pole 12 is threadably coupled to the handle 24.

The handle 24 has a peripheral wall extending from the proximal end 26 to the distal end 28. The peripheral wall has a plurality of finger grooves 42 therein. The proximal end 26 has a pair of raised portions 44 extending in generally a same direction as the post 22 and is positioned on opposite sides of the post 22. A line extending through the raised portions 44 is oriented parallel to the longitudinal axis of the roller 20.

A locking member 46 is mounted on the pole and releasably locks the pole to the roller mounting. The locking member 46 includes an outwardly biased detent 48 mounted on the pole 12. The detent 48 extends through an aperture 50 in the roller mounting 18. The detent 48 is positioned between the first end 14 of the pole 12 and the perimeter shoulder 40. The aperture 50 extends through the handle 24 between the distal end 28 and the well 36 and is intersected by a plane shared by the longitudinal axis of the pole 12 and the longitudinal axis of the roller 20. This aligns the aperture 50 with one of the raised portions 44. When the roller 20 is moved along a wall, the paint falling from the roller 20 will tend to stay on the sides of the handle 24 positioned between the raised portions 44. This will keep paint out of the aperture 50 and off of the detent 48.

In use, the roller mounting 18 is attached to the pole 12 and the paint roller 20 positioned on the roller mounting 18. Paint is then placed on the paint roller 20 and the paint roller 20 is rolled across a surface, such as a ceiling or wall. The detent 48 prevents the roller mounting 18 from unscrewing from the pole 12 and places less stress on the threads in the handle to prevent the handle from cracking.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A painting tool assembly comprising:

an elongated pole having a first end and a second end, said elongated pole having a length greater than three feet;

a roller mounting releasably coupled to a paint roller, said paint roller being rotatable along a longitudinal axis of the paint roller, said roller mounting receiving and being removably coupled to said first end of said pole, said roller mounting including;

a post;

an elongated handle being attached to said post, said handle having a proximal end and a distal end with respect to said post, said post being attached to said proximal end, said first end of said pole extending into said distal end of said handle; and said post including an extension portion and a roller portion, said extension portion positioning said roller portion in a spaced relationship with said handle, said roller portion extending into said paint roller and being collinear with said longitudinal axis of said paint roller, a longitudinal axis of said pole being oriented perpendicular to and bisecting said longitudinal axis of said paint roller;

said distal end of said handle having a lumen extending therein, said lumen having a terminal wall spaced from said distal end of said handle, said terminal wall having a threaded well extending therein, an outer surface of said pole adjacent to said first end being threaded and being extended into and threadably coupled to said threaded well;

said outer surface of said pole includes a perimeter shoulder, said shoulder abutting said distal end of said handle when said pole is threadably coupled to said handle; and a locking member being mounted on said pole and releasably locking said pole to said roller mounting.

2. The assembly according to claim 1, wherein said locking member includes an outwardly biased detect mounted on said pole, said detent extending through an aperture in said roller mounting.

3. The assembly according to claim 1, wherein said handle has a peripheral wall extending from said proximal end to said distal end, said peripheral wall having a plurality of finger grooves therein.

4. The assembly according to claim 1, wherein:

said proximal end has a pair of raised portions extending in generally a same direction as said post and being positioned on opposite sides of said post, a line extending through said raised portions being oriented parallel to said longitudinal axis of said roller; and said locking member including an outwardly biased detent mounted on said pole, said detent extending through an aperture in said roller mounting, said aperture being intersected by a plane shared by said longitudinal axis of said pole and said longitudinal axis of said roller.

5. The assembly according to claim 1, wherein said locking member includes an outwardly biased detent mounted on said pole, said detent extending through an aperture in said roller mounting, said aperture being intersected by a plane shared by said longitudinal axis of said pole and said longitudinal axis of said roller.

6. The assembly according to claim 1, wherein said locking member includes an outwardly biased detent mounted on said pole, said detent extending through an aperture in said roller mounting, said detent being positioned between said first end of said pole and said perimeter shoulder, said aperture extending through said handle between said distal end and said well, said aperture being intersected by a plane shared by said longitudinal axis of said pole and said longitudinal axis of said roller.

7. A painting tool assembly comprising:

an elongated pole having a first end and a second end, said elongated pole having a length greater than three feet;

a roller mounting releasably coupled to a paint roller, said paint roller being rotatable along a longitudinal axis of the paint roller, said roller mounting receiving and being removably coupled to said first end of said pole, said roller mounting including:

a post;

an elongated handle being attached to said post, said handle having a proximal end and a distal end with respect to said post, said post being attached to said proximal end, said first end of said pole extending into said distal end of said handle;

said post including an extension portion and a roller portion, said extension portion positioning said roller portion in a spaced relationship with said handle, said roller portion extending into said paint roller and being collinear with said longitudinal axis of said paint roller, a longitudinal axis of said pole being oriented perpendicular to and bisecting said longitudinal axis of said paint roller;

said distal end of said handle having a lumen extending therein, said lumen having a terminal wall spaced from said distal end of said handle, said terminal wall having a threaded well extending therein, an outer surface of said pole adjacent to said first end being threaded and being extended into and threadably coupled to said threaded well, said outer surface of said pole including a perimeter shoulder, said shoulder abutting said distal end of said handle when said pole is threadably coupled to said handle;

said handle having a peripheral wall extending from said proximal end to said distal end, said peripheral wall having a plurality of finger grooves therein;

said proximal end having a pair of raised portions extending in generally a same direction as said post and being positioned on opposite sides of said post, a line extending through said raised portions being oriented parallel to said longitudinal axis of said roller; and a locking member being mounted on said pole and releasably locking said pole to said roller mounting, said locking member including an outwardly biased detent mounted on said pole, said detent extending through an aperture in said roller mounting, said detent being positioned between said first end of said pole and said perimeter shoulder, said aperture extending through said handle between said distal end and said well, said aperture being intersected by a plane shared by said longitudinal axis of said pole and said longitudinal axis of said roller.

* * * * *